United States Patent [19]

Groh

[11] Patent Number: 4,780,799

[45] Date of Patent: Oct. 25, 1988

[54] HEAT-DISSIPATING LIGHT FIXTURE FOR USE WITH TUNGSTEN-HALOGEN LAMPS

[75] Inventor: Allen R. Groh, Roanoke, Tex.

[73] Assignee: Lighting Technology, Inc., Roanoke, Tex.

[21] Appl. No.: 68,560

[22] Filed: Jun. 30, 1987

Related U.S. Application Data

[63] Continuation-in-part of Ser. No. 922,152, Oct. 23, 1986, abandoned.

[51] Int. Cl.[4] ..... F21V 29/00

[52] U.S. Cl. ..... 362/294; 362/293; 362/373; 439/485; 165/1

[58] Field of Search ..... 362/264, 293, 373, 294, 362/457; 439/485, 486, 487, 592, 593, 599, 602, 710, 819, 904, 906, 137, 138; 361/386, 387, 388, 389; 165/1

[56] References Cited

U.S. PATENT DOCUMENTS

| | | | |
|---|---|---|---|
| 2,095,439 | 10/1937 | Higgins | 439/485 X |
| 2,307,302 | 1/1943 | Richardson | 240/47 |
| 2,477,957 | 8/1949 | Briskin | 240/47 |
| 2,854,562 | 9/1958 | Pratt | 240/3 |
| 3,152,852 | 10/1964 | Pistey | 339/112 |
| 3,265,885 | 8/1966 | Porter | 240/47 |
| 3,371,202 | 2/1968 | Moore et al. | 362/294 X |
| 3,402,383 | 9/1968 | Hilzen | 339/112 |
| 3,431,540 | 3/1969 | Kopelman et al. | 339/112 |
| 3,502,858 | 3/1970 | Habro et al. | 240/3 |
| 3,560,728 | 2/1971 | Atkins | 362/294 |
| 3,639,751 | 2/1972 | Pichel | 362/294 X |
| 3,936,686 | 2/1976 | Moore | 362/294 X |
| 3,978,361 | 8/1976 | Hiramoto | 313/35 |
| 4,111,515 | 9/1978 | Nigg | 339/112 |
| 4,536,832 | 8/1985 | Lemons | 362/264 |

FOREIGN PATENT DOCUMENTS

| | | | |
|---|---|---|---|
| 2645832 | 4/1978 | Fed. Rep. of Germany | 362/294 |
| 1247634 | 10/1960 | France | 439/592 |
| 571684 | 1/1976 | Switzerland | 362/373 |
| 0962684 | 9/1982 | U.S.S.R. | 362/294 |
| 981307 | 4/1962 | United Kingdom . | |
| 1504689 | 3/1978 | United Kingdom | 362/294 |

OTHER PUBLICATIONS

"IBM Technical Disclosure Bulletin", vol. 20, No. 11a, E. Berndlmaier, J. A. Dorler and J. G. Peace, Jr.

*Primary Examiner*—Samuel Scott
*Assistant Examiner*—Carl D. Price
*Attorney, Agent, or Firm*—Hubbard, Thurman, Turner & Tucker

[57] ABSTRACT

A heat-dissipating light fixture for use with a tungsten-halogen lamp has an externally finned metal body provided with an internal cavity divided into two opposite portions by an integrally formed heat shield having a socket opening formed therethrough. An electrical connector is secured to one side of the heat shield, over the socket opening, and a graphite foil disc is secured to the other side of the heat shield, the foil disc having central tab portions which overlie the socket opening. The lamp is installed in the fixture by pressing the lamp base portion through the foil disc and the socket opening until the connecting prongs of the lamp enter prong openings in the connector. Insertion of the lamp base into the socket opening bends the foil tabs into the opening where they are compressed between the lamp base and the interior surface of the socket opening. The heat shield intercepts and absorbs infrared radiation generated by the lamp reflector toward the connector. Additionally, heat from the lamp base is conducted, via the foil tabs, to the heat shield. The heat transmitted to the heat shield is conducted outwardly therethrough to the fixture body and dissipated by the fins thereon to surrounding ambient air, thereby protecting the lamp and its connector from excessive heat build-up.

15 Claims, 5 Drawing Sheets

HEAT-DISSIPATING LIGHT FIXTURE FOR USE WITH TUNGSTEN-HALOGEN LAMPS

CROSS-REFERENCE TO RELATED APPLICATION

This application is a continuation-in-part of pending U.S. application Ser. No. 922,152 filed on Oct. 23, 1986, now abandoned.

BACKGROUND OF THE INVENTION

The present invention relates generally to lighting apparatus, and more particularly provides a uniquely constructed heat-dissipating light fixture for use with tungsten-halogen lamps.

The vast majority of lights currently used in retail and exhibition display applications are incandescent flood lamps which range in power from 100 watts to 300 watts. Despite the prevalance of its use, incandescent display lighting is subject to several well known disadvantages and limitations. For example, the efficiency of incandescent lamps is limited to approximately eight to eleven percent, which results in high electrical power consumption compared to the useful light obtained. Additionally, the spectrum of the light generated by incandescent display lamps is heavily weighted toward the infrared portion of the spectrum. This results in relatively poor color balance of the displayed objects.

Moreover, heat that is generated by the infrared component of incandescent display lamps is projected forwardly, thereby potentially creating undesirably high temperatures on the illuminated merchandise. This last point is particularly relevant where bright lighting is required for expensive or irreplacable objects as clothing, furs, jewelry, or paintings. It is well known that concentrated infrared energy can significantly deteriorate the object at which it is directed. As an example, infrared energy can change the molecular structure of diamonds and other precious stones, thereby significantly decreasing their value. Additionally, watches are particularly sensitive to heat, and are easily damaged under incandescent lighting.

As an alternative to high wattage, low efficiency incandescent lighting, dichroic, tungsten-halogen low voltage lamps have recently been utilized in display applications and potentially offer several distinct advantages over incandescent lighting systems. For example, the efficiency of tungsten-halogen low voltage lamps is approximately ten times that of incandescent lamps. At 12 volts, a 75 watt tungsten-halogen lamp produces essentially the same amount of usable light as a much higher wattage incandescent lamp, and produces more of the light output in the visible spectrum. This, of course, represents a significant energy savings. Additionally, the life of a tungsten-halogen lamp is approximately 2.5 to 3 times that of an incandescent lamp due to the "halogen cycle" which redeposits evaporated tungsten on the lamp's filament, preventing blackening of the lamp envelope and also prolonging the life of the tungsten filament.

The color spectrum of the light produced by tungsten-halogen lamps provides a truer color representation for illuminated objects due in part to the high "white hot" temperature that the tungsten filiment is heated to, and to the special dichroic coating on the lamp reflector which reflects visible light and absorbs other transmitted frequencies such as infrared. Finally, projected heat from a tungsten-halogen lamp is significantly reduced by its dichroic reflector which absorbs approximately 70 percent of the infrared radiation (as well as ultraviolet) resulting in a safe light for illuminating delicate merchandise.

It can be seen that these advantages inherent in tungsten-halogen lamps make them a very desirable light source for many retail and other commercial applications. However, the conventional fixtures in which these tungsten-halogen lamps are typically housed significantly shorten the useful life of such lamps. This is due primarily to the inability of conventional fixtures to adequately dissipate the intense heat produced at the rear of the lamp by the high temperature tungsten filament and by the reflector-absorbed infrared energy. A typical method of installing a tungsten-halogen lamp in the conventional light fixture is simply to plug the connecting prongs of the lamp into a connector fitting disposed within the fixture. Other than allowing the heat from the lamp base portion to be somewhat dissipated by convective transfer to air within the fixture surrounding the lamp, no adequate heat dissipation mechanism has heretofore been incorporated in these fixtures.

This deficiency in conventional fixture design leads to premature lamp failure in three primary modes due to excessive heat buildup in the lamp. First, the seal portion of the lamp often fails, thereby allowing the halogen gas within the glass envelope to escape, due to interior seal temperatures exceeding 350° C. The lamp seal is typically made of electrically conductive strips such as molybdenum, pressed between the quartz envelope. Due to the high filament temperature and high current (6.25 amps at 75 w) flowing through the strips they often reach very high temperatures. Additionally, if the reflector temperature is allowed to exceed approximately 350° C., the reflector's dichroic coating can deteriorate. Finally, the connector fitting within the fixture can also be caused to fail due to the high temperature transmitted from the lamp base to the connector pins. Excessively high temperature can result in increasing resistance and eventual breakdown of the connector pin and of the power supply connection thereto.

It can be seen from the foregoing that a need exists for an improved light fixture for use with tungsten-halogen lamps which eliminates or substantially minimizes above-mentioned and other lamp heat buildup problems and limitations. Accordingly, it is an object of the present invention to provide such a fixture together with associated lamp heat-dissipating methods.

SUMMARY OF THE INVENTION

In carrying out principles of the present invention, in accordance with a preferred embodiment thereof, a uniquely constructed heat-dissipating light fixture is provided for use with tungsten-halogen lamps to significantly prolong their operating life by preventing excessive heat buildup in such lamps. The fixture comprises a heat conductive, externally finned metal body in which a cavity is formed for receiving a tungsten-halogen lamp, the cavity opening outwardly through the exterior surface of the fixture body. Operatively disposed within the cavity is an electrical connector which is connected to suitable external power wiring and has a pair of openings formed therein for receiving the connector prongs which extend outwardly from the base portion of the lamp.

Also disposed within the fixture body cavity is a metal heat shield which engages around its periphery the interior surface of the cavity and is positioned adjacent the electrical connector. A socket opening is formed through the heat shield and is adapted to receive the base portion of the lamp so that the reflector portion of the lamp is disposed on one side of the heat shield and the electrical connector is disposed on the other side. The lamp is operatively connected to the electrical connector by passing the lamp base portion through the socket opening until the lamp connector prongs are received in the corresponding openings in the electrical connector.

A compliant, heat conducting material, such as a suitable graphite foil, is secured to the reflector side of the heat shield and has a portion which projects into the socket opening. When the lamp is plugged into the connector through the socket opening, a portion of the graphite foil is bent inwardly into the socket opening and is compressed between the lamp base portion and an interior surface portion of the socket opening. The slightly compressed portion of the foil provides an efficient heat conduction flow path between the exterior surface of the lamp base portion and the interior surface of the socket opening in the heat shield.

During operation of the tungsten-halogen lamp, the heat shield interposed between the electrical connector and the reflector portion of the lamp functions to intercept infrared radiation transmitted from the reflector toward the connector. The infrared radiation intercepted by the foil-faced heat shield is absorbed therein and transferred therethrough by conduction to the metal fixture body which serves as a conductive heat sink. Additionally, heat within the lamp base (adjacent the lamp seal portion) is very efficiently conducted through the compressed foil portion into the heat shield, and, again by conduction, into the fixture body heat sink. The external fins on the fixture body enhance the dissipation of heat conducted thereto by means of radiation and convection to the surrounding ambient air.

In this unique manner, both the reflector and base portions of the lamp, and the electrical connector portion of the fixture, are protected from excessive heat buildup in a manner maintaining the temperature of the connector and the lamp base below acceptable limits to thereby significantly prolong the useful life of the lamp. Typically, a lamp seal temperature reduction of approximately 30% is achieved compared to seal temperatures of tungsten-halogen lamps housed in conventional fixtures.

In an alternate embodiment of the light fixture, the finned body portion thereof is inexpensively formed from a tubular metal inner section and a series of metal discs. Central circular portions of the discs are punched out, provided with appropriate openings therethrough and then pressfitted into the interior of the tubular section to form the heat shield and connector support structure within the body. The remaining annular portions of the discs are axially pressfitted onto the tubular section to form the external cooling fins on the light fixture body.

According to another aspect of the present invention, a specially designed cooled lamp connector assembly is provided which may be utilized, in retrofit applications, to replace the existing electrical lamp connector within the outer housing of a conventional light fixture. The improved connector assembly is preferably formed from two extruded aluminum sections which are suitably intersecured to form a hollow, externally finned cooling body section of the assembly. This body section, at the front end thereof has a socket opening which extends inwardly into an enlarged cavity within the body.

Captively retained within this enlarged internal cavity is a uniquely configured lamp connector structure which comprises two stacked pairs of metal blocks that are positioned in a side-by-side relationship, and are encapsulated within and separated by a silicon insulating material that is highly resistive to the flow of electricity therethrough, but has relatively good thermal conductivity. A pair of electrical power leads are each connected to one of the metal block pairs. A forwardly facing opening is formed in the silicon insulation material and communicates with the socket opening formed in the cooling body. A back portion of the cooling body has suitably secured thereto a connecting bolt by means of which the body may be mounted in the interior of an existing light fixture housing.

With the cooling body mounted within the light fixture housing, the base of the fixture's lamp is inserted into the socket opening formed in the cooling body so that the lamp base pins enter a pair of pin openings formed along the junctures of the stacked metal block pairs. The pairs of such blocks are resiliently held in engagement by the silicon insulation material which encapsulates and separates them. As the lamp base pins enter the pin openings in the blocks, each pair of the blocks is slightly separated against the resilient force of the encapsulating insulation material. This provides a desirable "pin wiping" action in the connector which is inexpensively achieved due to its unique construction.

With the lamp base secured to the internal connector in this manner, a forward end portion of the cooling body defines a heat shield which is interposed between the reflector portion of the lamp and the captively retained connector structure disposed within the cooling body. In a manner similar to that previously described, a graphite foil sheet is held by the cooling body and is compressed between the lamp base and the inner surface of the socket opening formed in the body.

During operation of the lamp, rearwardly directed radiant heat from its reflector portion is intercepted by the integral heat shield portion of the cooling body. The absorbed heat is dissipated by the finned portion of the body into the interior of the light fixture housing to thereby shield the internal lamp connector, and the lamp base and its internal seal elements, from such heat. The compressed portion of the graphite foil sheet forms a conductive heat path from the lamp base to the cooling body to thereby further protect the internal seal elements from excessive heat.

The metal block structure which defines the interior portion of the lamp connector structure functions as a heat sink to absorb further heat transmitted to the connecting pins from the lamp base. Heat received in these metal blocks from the connector pins is conducted outwardly to the silicon encapsulating material, into the cooling body, and is then dissipated into the interior of the light fixture housing through the finned portions of the body, and is further conducted into the light fixture housing through a rear end portion of the cooling body that is bolted to the light fixture housing. In this manner, the improved connector assembly provides additional protection against excessive heat buildup in the connecting pins to further prolong the life of the lamp.

In an alternate embodiment of the cooled lamp connector assembly, its externally finned cooling body is formed from two aluminum extrusions which are positioned in a spaced, side-by-side relationship. The two extruded metal body sections are encapsulated within and separated by a silicon insulation material similar to that previously described. A pair of electrical power leads are each connected to one of the extruded metal sections.

The cooling body has a lamp base socket formed in a forward end portion thereof and is provided at its rear end with a suitable connecting bolt for connecting the body to the interior of an existing light fixture housing.

At the inner end of the socket opening each of the extruded sections is split along a rearwardly extending cut line which terminates somewhat forwardly of the rear end of the extrusion. At the section junctures defined by this cut line are formed a pair of lamp base pin openings. The non-split rear portions of the extruded sections function, in effect, as spring portions of the sections to resiliently resist separation of the split portions thereof.

With the cooling body installed within the light fixture housing, the base of the fixture's lamp is inserted into the socket opening of the body so that the lamp base pins enter the pin openings. Entry of the pins into their associated openings slightly forces the split portions of the extruded metal sections apart to thereby provide the previously described automatic "pin-wiping" action. A graphite foil strip is secured within the socket opening and has portions which are compressed between the lamp base and the interior surface of the socket opening as previously described.

As in the case of the previously described embodiment of the improved connector assembly, a forward end portion of the cooling body defines a heat shield interposed between the lamp reflector and the portion of the assembly which receives the lamp base pins. Intercepted radiant heat, and heat within the lamp base and its connecting pins are absorbed within the extruded metal sections, and dissipated by the body fins into the interior of the light fixture housing, as well as being conducted from the metal extrusions into the light fixture housing through the encapsulating silicon material.

In this latter embodiment of the improved connector assembly, no separate internal connector structure is required. The cooling body itself integrally defines such structure in addition to performing its various cooling and heat dissipation functions.

While the improved connector assembly apparatus described above is particularly well suited for retrofit applications in which the existing connector is removed from a light fixture and replaced with an embodiment of the improved connector assembly, it will be appreciated that such improved assembly could also be used as original equipment in a newly manufactured fixture if desired. dr

DETAILED DESCRIPTION

Figure 1:
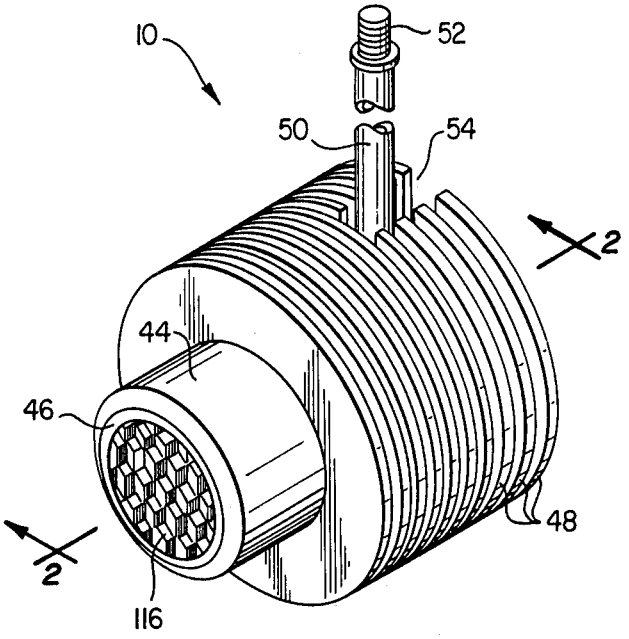
FIG. 1 is a perspective view of a heat-dissipating light fixture which embodies principles of the present invention and may be advantageously used in conjunction with a tungsten-halogen lamp to efficiently illuminate various display objects.
Figure 2:
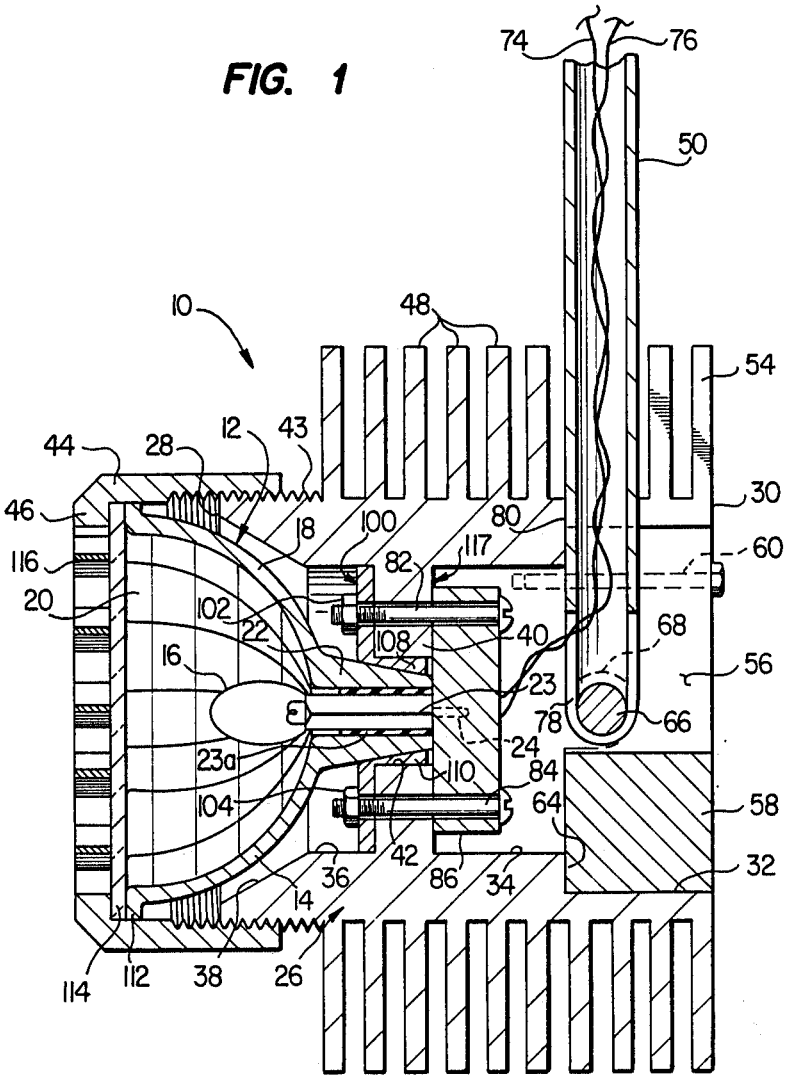
FIG. 2 is an enlarged scale cross-sectional view taken through the light fixture along line 2—2 of FIG. 1.
Figure 3:
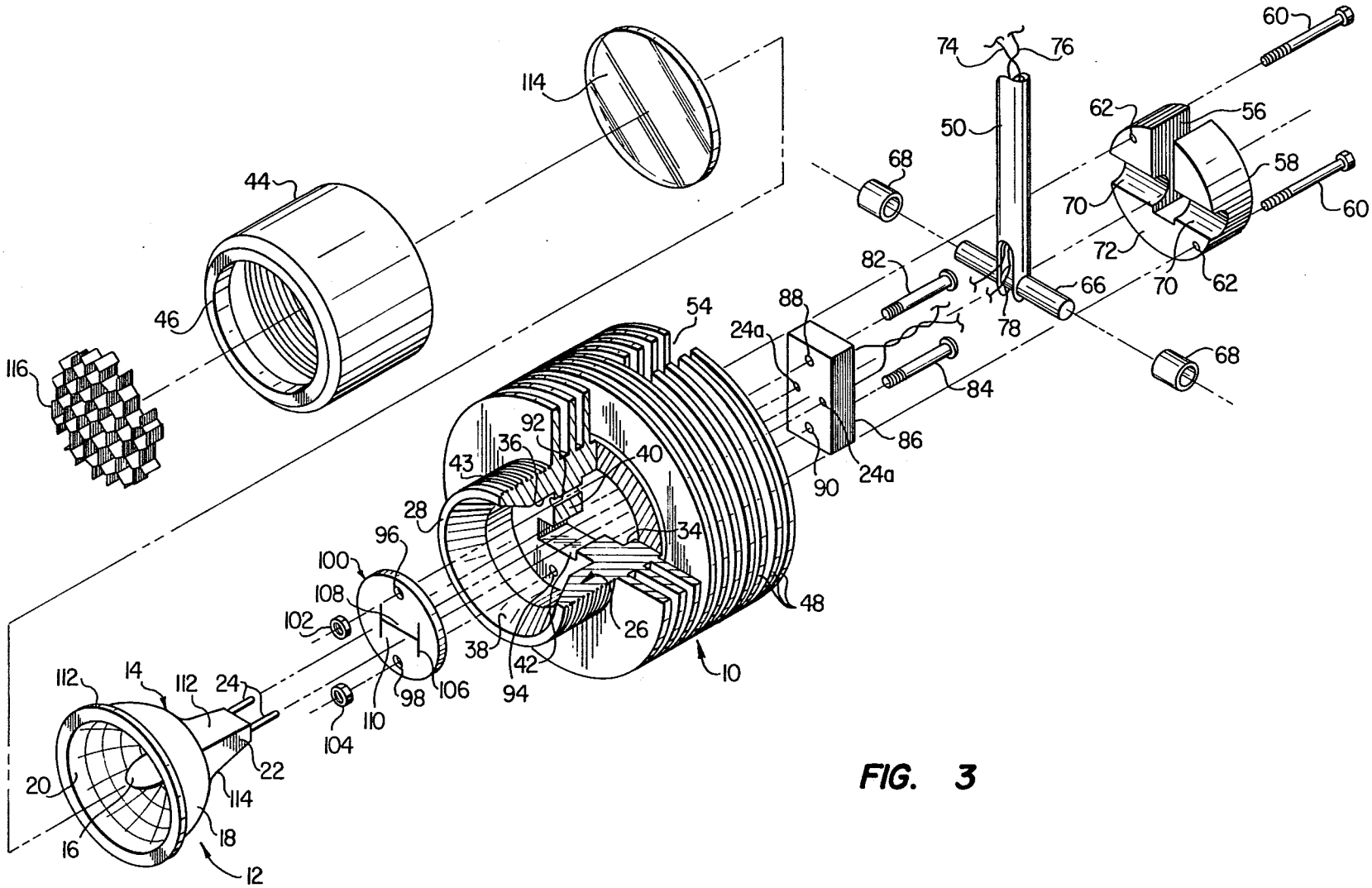
FIG. 3 is an exploded perspective view, partially in section, of the light fixture.

As illustrated in FIGS. 1-3, the present invention provides a uniquely constructed heat-dissipating light fixture 10 adapted for use with a conventional tungsten-halogen lamp 12 comprising a glass reflector housing 14 and a tungsten-halogen bulb 16. The reflector housing 14 has a forwardly disposed reflector portion 18 whose inner surface is provided with a dichroic reflective coating 20, and a rearwardly disposed hollow base portion 22 which is tapered along its length and has a generally rectangular cross-section. The back end of the bulb 16, which contains its critical seal portion 23 (FIG. 2), is extended rearwardly through the hollow lamp base 22 and is secured therein by a suitable ceramic potting material $23_a$ which encapsulates the bulb within the base 22. The back end of the bulb 16 is provided with a pair of connecting prongs 24 (FIGS. 2 and 3) which project rearwardly from the lamp base 22.

During operation of the lamp 12, the dichroic reflector coating 20 reflects visible light from the bulb 16 forwardly (i.e., leftwardly) from the reflector portion 18, while a large portion of the infrared radiation from the bulb is absorbed by the reflector coating 20 and radiated rearwardly (i.e., rightwardly) from the reflector portion 18. When a tungsten-halogen lamp such as lamp 12 is installed in a conventional light fixture, by simply plugging the connector prongs 24 into an electrical connector disposed within the fixture, the combination of the intense tungsten filament heat in the bulb 16 and the rearwardly generated infrared radiation tends to overheat the lamp base 22, thereby rather rapidly deteriorating the internal seal 23 within the bulb 16, the connector prongs 24, and the electrical connector which receives these prongs. Additionally, the intense heat generated by the bulb 16, which is absorbed by the reflector housing 14, can cause deterioration of the reflector coating 20. These overheating problems are eliminated in a novel manner by the light fixture 10 which will now be described.

Fixture 10 includes a hollow cylindrical aluminum body 26 having a front end 28 and a back end 30. A cavity is formed within the body 26 by cylindrical bores 32, 34 and 36 extending axially therethrough. Bore 32 extends inwardly from the back end 30 of the fixture body 26 and inwardly communicates with the smaller diameter bore 34. Bore 36 extends inwardly from the front end 28 of the housing body and has a conically flared forward end portion 38 as best illustrated in FIG. 2.

The bores 34 and 36 are separated by a cylindrical internal dividing wall 40 formed integrally with the balance of the fixture body 26. Extending centrally through the wall 40 is a rectangularly cross-sectioned socket opening 42 whose height and width are just slightly larger than the height and width of the lamp base 22.

A front end portion of the fixture body 26 is externally threaded, as at 43, and has secured thereto an annular, internally threaded aluminum cap 44 having at its forward end an annular, radially inwardly projecting lip 46. Extending between the inner end of the externally threaded portion 43 and the back end 30 of the fixture body is an axially spaced series of radially outwardly projecting annular cooling fins 48 which are formed integrally with the balance of the fixture body.

The light fixture 10 may be operatively connected to a conventional lighting power track disposed above the fixture by means of an elongated hollow cylindrical support rod 50 having a threaded upper end portion 52. A lower end portion of the support rod 50 is extended into the bore 32 through a slot 54 formed downwardly through a rear end portion of the fixture body 26 and the series of cooling fins 48. The lower end portion of the support rod 50 is also received within a radially inwardly extending slot 56 formed in a cylindrical bearing cap 58 which is disposed within the bore 32. Bearing cap 58 is secured to the housing body by means of a pair of screws 60 which extend through openings 62 in the cap 58 and are threaded into an annular shoulder 64 defined between the bores 32, 34 within the fixture body 26.

The fixture body 26 is pivotally connected to the lower end of the support rod 50 by means of an elongated pivot pin 66 which extends transversely through the lower end of the rod 50 as best illustrated in FIG. 3. The outwardly projecting end portions of the pin 66 are received in small resilient bearing sleeves 68 which are in turn received in arcuately cross-sectional radial slots 70 formed in the inner end surface 72 of the bearing cap 58. The sleeved pin 66, together with the bearing cap 58, pivotally connects the fixture body 26 to the support rod 50, thereby permitting the light fixture 10 to be pivotally adjusted in a counterclockwise direction from the position of the light fixture illustrated in FIGS. 1 and 2.

By selectively tightening or loosening the bearing cap screws 60 the bearing sleeves 68 may be compressed to a predetermined degree between the bearing cap slots 70 and the pivot pin 66 to thereby frictionally maintain the light fixture in its pivotally adjusted position.

Suitable power wires 74, 76 are extended downwardly through the interior of the support rod 50 and into the interior of the bore 34 through a small slot 78 (FIG. 3) formed through a lower end of the forwardly facing sidewall surface 80 of the support rod. The inner ends of the power wires 74, 76 are operatively connected to a rectangular ceramic electrical connector 86 disposed within the bore 34.

Screws 82, 84 are respectively extended through suitable mounting holes 88, 90 formed in the connector 86, and are additionally extended through mounting holes 92, 94 formed through the internal wall 40 and corresponding mounting holes 96, 98 formed through a graphite foil disc 100 disposed in the bore 36 and having a diameter generally equal to that of the internal wall 40. Retaining nuts 102, 104 are threaded onto the outer ends of the screws 82, 84 to thereby clamp the connector 86 to the rear end surface of the wall 40 over the socket opening 42, and clamp the foil disc 100 to the front end surface of the wall 40 as best illustrated in FIG. 2.

The foil disc 100, which plays an important role in the present invention, has formed through a central portion thereof an H-shaped cut 106 (FIG. 3) which forms in the disc upper and lower tab portions 108, 110. With the cap 44 removed, the tungsten-halogen lamp 12 is installed in the fixture 10 by pushing the tapered lamp base 22 rearwardly through the foil cut area 106 and the socket opening 42 until the lamp connector prongs 24 enter prong-receiving openings $24_a$ (FIG. 3) formed in the forward end surface of the electrical connector 86. Insertion of the lamp base 22 into the socket 42 in this manner bends the foil tabs 108, 110 rearwardly into the socket 42 so that the tabs respectively engage and are compressed by the upper and lower side surfaces 112, 114 (FIG. 3) of the lamp base 22, the degree of such compression varying along the lengths of the tabs (as illustrated in FIG. 2) due to the tapered configuration of the lamp base 22. Importantly, the tabs 108, 110 which are compressed between the lamp base 22 and the upper and lower interior side surfaces of the socket 42, form a highly efficient heat conductive thermal flow path between a substantial exterior surface portion of the lamp base 22 and the internal wall 40 which circumscribes it.

The assembly of the light fixture 10 may then be completed by screwing the cap 44 onto the externally threaded forward end portion 43 of the fixture body 26. With the cap 44 installed, the interior surface thereof engages and supports an annular, outwardly projecting flange 112 on the front end of the lamp reflector portion 18, the flange 112 being spaced rearwardly from the cap lip 46 as best illustrated in FIG. 2. If desired, a circular lens element 114 may be dropped into the cap 44 prior to its installation on the fixture body so that the lens is captively retained between the lamp 12 and the cap lip 46 as illustrated in FIG. 2. Additional lens elements, such as "beam shaping" lenses may also be positioned between the lamp and the cap lip. If needed, a circular anti-glare grid member 116 may be pressed into the interior of the cap lip as illustrated.

The unique heat-dissipating characteristics of the light fixture 10 will now be described in detail with particular reference to FIG. 2. As previously mentioned, during operation of the lamp 12 the high intensity tungsten-halogen bulb 16 generates both visible light and infrared radiation. The dichroic reflector coating within the reflector portion 18 forwardly (i.e., leftwardly in FIG. 2) reflects the visible light toward the display object (not shown) to be illuminated. However, a very substantial portion of the infrared radiation is absorbed by the dichroic coating 20 (and thus the reflector portion 18) and radiated rearwardly from the reflector portion toward the electrical connector 86. A portion of the heat absorbed by the reflector portion 18 is also conducted therefrom into the lamp base 22.

It can be seen in FIG. 2 that the foil-faced internal wall 40, which circumscribes the lamp base 22, is interposed between the lamp reflector portion 18 and the electrical connector 86. Because of this unique interposition of the internal wall 40, it functions (together with a circumferential portion of the foil element 100) as heat shield means 117 for intercepting rearwardly directed infrared radiation emanating from the lamp reflector portion 18, thereby shielding the electrical connector 86 from such radiation. Radiation intercepted by the heat shield 117 is absorbed thereby, and heat from the absorbed radiation is conducted radially outwardly through the heat shield into the fixture body 26 which functions as a conductive heat sink. The cooling fins 48 function to convectively and radiantly dissipate to the surrounding ambient air heat conducted into the fixture body 26.

Heat conducted into the lamp base 22 from the lamp reflector portion 18 is very efficiently conducted from the lamp base into the internal wall 40 through the highly conductive foil tabs 108 and 110. Heat transmitted in this manner to the internal wall 40 is also conducted therethrough into the fixture body 26 and convectively and radiantly dissipated by the cooling fins 48.

It can readily be seen that the internal wall 40 operates in conjunction with the foil disc 100 to uniquely protect the connector 86, the lamp base 22 and the connecting prongs 24 from excessive heat buildup which, in fixtures of conventional design, lead to premature failure of the tungsten-halogen lamp. The novel conductive heat flow path defined by the wall 40 and the foil disc 100 also reduces the operating temperature of the dichroic foil coating 20 to prevent premature deterioration thereof. Because of the reduced operating temperature of the electrical connector 86 provided by the present invention, the power wiring to the connector is also protected from heat-induced burn out.

It will be appreciated that the thermally conductive heat flow path provided between the lamp base 22 and the internal wall 40 by central portions of the foil disc 100 may be alternately provided by other means if desired. For example, heat conductive compliant materials other than graphite foil may be interposed between the lamp base and the interior surface of the socket 42. While graphite foil has proven to be particularly well suited for providing this conductive heata link, other materials such as pliable silicon elements could also be employed. Alternatively, a suitable heat conductive grease could be used.

It will also be appreciated that the compliancy of the compressed foil tabs 108, 110 allows them to conform to and engage a substantial portion of the upper and lower lamp base surfaces 112, 114 disposed in the socket 42. Alternatively, relatively non-compliant conductive heat transfer elements could also be used. However, such non-compliant elements would not be as thermally efficient since they normally would not contact the upper and lower lamp base surfaces as uniformly and completely as a compliant material would.

As previously described, the internal wall 40 is conveniently formed integrally with the balance of the fixture body 26. If desired, however, the wall 40 could be formed separately and internally connected to the fixture body, in heat conductive communication therewith, in another suitable manner.

In the preferred embodiment of the light fixture 10 described above, the foil disc 100 is conveniently secured to and covers the front end surface of the internal wall 40 so that the heat shield means 117 are collectively defined by the wall 40 and a radially outer portion of disc 100. However, a variety of other methods of attaching the foil or other heat conductive element to the internal wall could be utilized so that the front surface of wall 40 would not be covered by foil or other heat conductive material. In such instance wall 40 would directly intercept infrared radiation from the lamp's reflector portion and would by itself define the heat shield means 117.

Unlike conventional fixtures used to house tungsten-halogen lamps such as lamp 12, the light fixture 10 of the present invention does not to any appreciable degree rely on internal convection to dissipate heat from the lamp. Accordingly, the fixture 10 may be sealed (by, for example, the lens 114) to render the fixture suitable for outdoor use. Moreover, since internal air cooling need not be employed in the fixture 10, auxiliary cooling fans are not required, and no "light leaks" through body cooling openings are created.

Finally, while the fixture 10 of the present invention is particularly well suited for use with tungsten-halogen lamps such as lamp 12, it could also be used with other high intensity lamps having base portions which are prone to excessive heat buildup.

Figure 4:
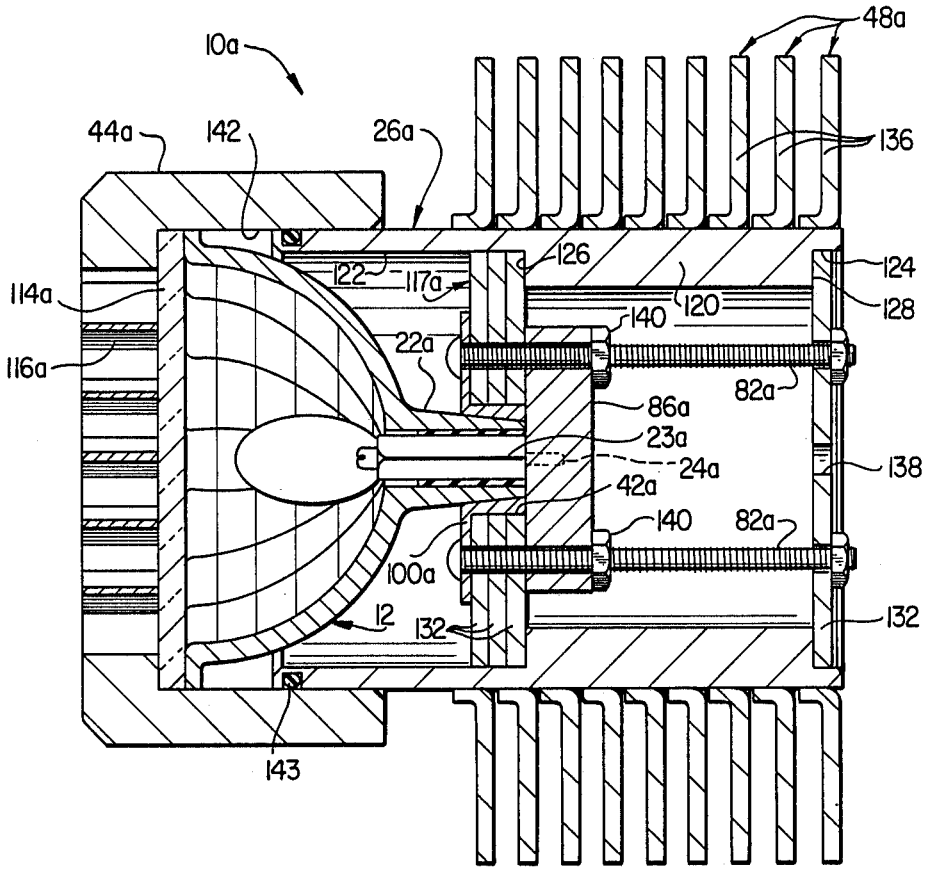
FIG. 4 is a cross-sectional view, similar to that in FIG. 2, illustrating an alternate embodiment of the light fixture.

The body 26 of the light fixture 10 just described, together with its external cooling fins 48, may be machined from a single block of aluminum to provide the fixture body with a very pleasing exterior appearance unbroken by assembly joint lines. However, this body fabrication technique results in a considerable amount of scrap metal which normally must be discarded. Cross-sectionally illustrated in FIG. 4 is an alternate embodiment $\mathbf{10}_a$ of the light fixture 10 which is considerably less expensive to produce and generates a significantly diminished amount of scrap metal. Components in the fixture $\mathbf{10}_a$ similar to those in fixture 10 have been given the same reference numerals, but with the subscript "a".

The body $\mathbf{26}_a$ of fixture $\mathbf{10}_a$ has an inner section defined by a length of aluminum tubing 120 which has a counterbore 122 extending axially into a forward end portion thereof, and an equal diameter counterbore 124 extending axially into a rear end portion thereof. Counterbores 122 and 124 respectively define within the tubular body section 120 annular forwardly and rearwardly facing ledges 126 and 128.

Figure 5:
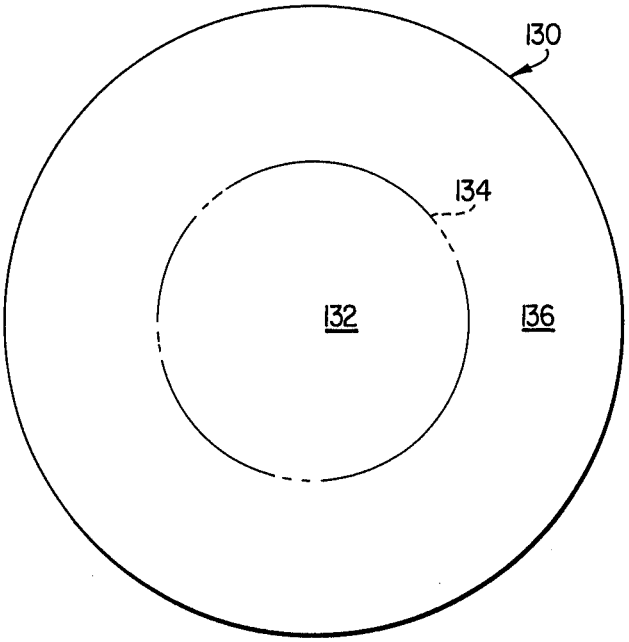
FIG. 5 is a reduced scale front elevational view of a metal disc used to form one of the external housing fins on the light fixture of FIG. 4, and also to form a portion of the lamp connector heat shield and support structure therein.

The external body cooling fins $\mathbf{48}_a$ are formed from portions of a series of this aluminum discs 120, one of which is representatively depicted in FIG. 5. A central circular portion 132, having a diameter slightly larger than those of the counterbores 122 and 124, is punched from each of the discs 130 as indicated by the dashed punchline 134, leaving an annular disc portion 136 having an inner diameter somewhat smaller than the outer diameter of the tube 120. The annular disc portions 136 are axially press-fitted onto a rear portion of the tube 120 to form the longitudinally spaced external cooling fins $\mathbf{48}_a$ as indicated in FIG. 4.

To form the internal heat shield means $\mathbf{117}_a$ within the fixture body $\mathbf{26}_a$, central rectangular openings are formed through three of the punched-out central disc portions 132, and these three central disc portions are press-fitted into the open forward end portion of the tube 120 until they abut the forward annular ledge 126. The rectangular openings in these three disc portions are appropriately aligned to collectively define therein the lamp base socket opening $\mathbf{42}_a$. If desired, a greater or smaller number of the central disc portions could be used to define the heat shield means $\mathbf{117}_a$, depending on the thickness of the individual central disc portions and the overall thickness desired for the heat shield.

The open back end of the tube 120 is closed by a fourth central disc portion 132 which is press-fitted into the counterbore 124 until it abuts the rearwardly facing annular ledge 128. A suitable circular opening 138 is formed in this disc portion to define an outlet opening for the power leads (not illustrated) from the electrical connector $86_a$. Connector $86_a$ is supported within the body $26_a$ by means of bolts $82_a$ which extend through the heat shield $117_a$, through the connector $86_a$, and through the rearwardly disposed central disc portion 132. The connector $86_a$ is tightened against the rear surface of the heat shield $117_a$ by means of nuts 140 threaded onto the bolts $82_a$. The graphite foil strip $100_a$, which is interposed between the lamp base $22_a$ and the interior surface of the socket opening $42_a$, is secured to the front surface of the heat shield $117_A$ by the heads of the bolts $82_a$ as illustrated.

The body cap $44_a$, which holds the lens $114_a$ in place, is provided with a smooth interior surface 142 which may be slipped onto the forward end of the tube 120 and held in frictional engagement therewith by means of an O-ring member 143 carried in a suitable groove formed around the exterior periphery of the forward end of the tube 120.

It can be seen that the light fixture $10_a$ is at least somewhat less expensive to produce than the previously described fixture 10 and generates less scrap in the fabrication process. Of the previously described components used to fabricate the body $26_a$ of the fixture $10_a$, the only portions that are discarded are the central disc portions 132 not used, and the small amount of scrap material resulting from the formation of the counterbores 122 ans 124. Further, with the exception of forming such counterbores, no machining is required to form the body $26_a$.

The foregoing portion of this description has focused upon the present invention's provision of an entire light fixture assembly which uniquely functions to substantially prolong the life of a lamp housed therein by significantly reducing the operating temperature of portions of the lamp, and the conventional electric connector into which it is plugged. However, as will now be described, the present invention also provides unique retrofit apparatus which may be used to modify an existing light fixture to incorporate therein the novel lamp heat dissipating principles incorporated in the fixtures 10 and $10_a$.

Figure 6:
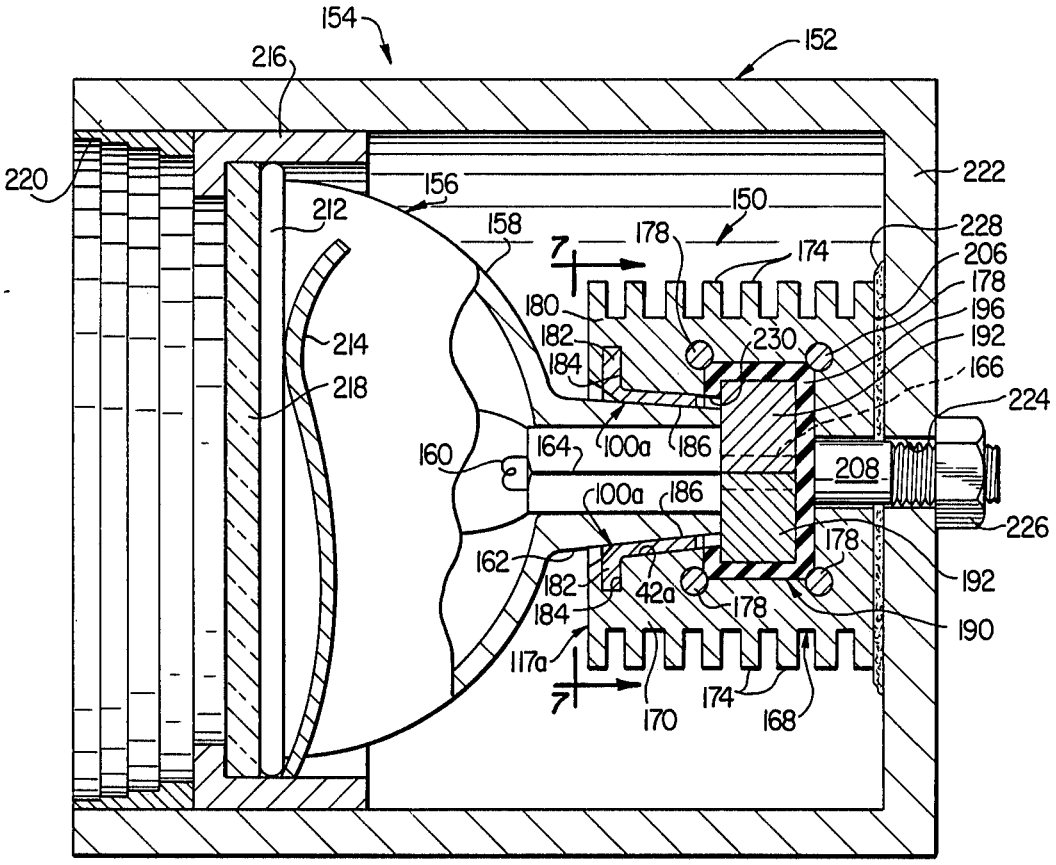
FIG. 6 cross-sectionally depicts a heat dissipating retrofit connector assembly which embodies principles of the present invention operatively installed within an existing lamp fixture and having a lamp connected thereto.
Figure 7:
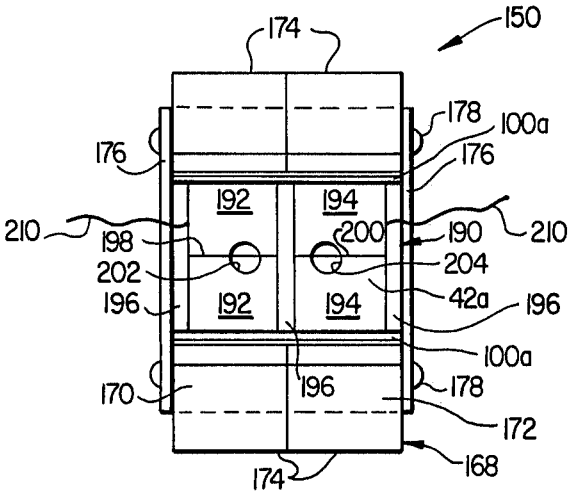
FIG. 7 is a front elevational view of the connector assembly, with the lamp being removed therefrom, taken generally along line 7—7 of FIG. 6.

With reference now to FIGS. 6 and 7, the present invention also provides a uniquely designed heat dissipating lamp connector assembly 150 which may be used in retrofit applications to replace the conventional ceramic connector (not shown) disposed within the exterior housing 152 of a conventional light fixture 154 that utilizes a tungsten-halogen lamp 156 having a reflector 158, a filament 160, a tapered base portion 162 having seal strips 164 therein, and a pair of connecting pins or prongs 166.

The heat dissipating connector assembly 150 includes a hollow cooling body 168 which is preferably formed from two extruded aluminum sections 170, 172 which have a series of external cooling fins 174 formed on their upper and lower sides. The extruded sections 170, 172 are intersecured in a side-by-side contiguous relationship (FIG. 7) by a pair of aluminum clamping panels or plates 176 which are held against opposite external side surfaces of the two extruded sections by four connecting bolts 178 extending through the sections 170 and 172 and the panels 176.

A forward end portion 180 of the cooling body 168 defines the heat shield means $117_a$ and has a rectangularly cross-sectioned socket opening $42_a$ extending rearwardly therethrough. Side edge portions 182 of a pair of rectangularly shaped graphite foil elements $100_a$ are captively retained in a pair of upper and lower slots 184 formed in the interior surface of the socket opening $42_a$ so that the remaining portions 186 of the foil elements $100_a$ are bendable into the socket opening $42_a$ as best illustrated in FIG. 6.

The cooling body 168 is also provided with an enlarged, rectangularly cross-sectioned internal cavity 188 which is positioned rearwardly of and communicates with the socket opening $42_a$. Clamping plates 176 define opposite side wall portions of both the socket openings $72_a$ and the cavity 188.

Captively retained within the cavity 188 is a connector portion 190 of the assembly 150 which includes two pairs of vertically stacked copper blocks 192 and 194 that are positioned in a spaced, side-by-side relationship within the internal cavity 188. The blocks 192, 194 could alternatively be formed from another metal having both high thermal conductivity and high electrical conductivity. The stacked block pairs 192, 194 are encapsulated within and separated by a silicon insulating material 196 which engages the interior surface of the cavity 188. The insulating material 196 is highly resistive to electrical current flow therethrough, but has a relatively high degree of thermal conductivity. Extending rearwardly through the block pairs 192, 194, along their juncture areas 198 and 200, are a pair of connector pin openings 202, 204. Secured to the rear end surface 206 of the cooling body 168 is a suitable connecting bolt 208 formed from an electrical insulating material. To provide electrical power to the connector portion 190 of the assembly 150, a pair of power lead wires 210 are suitably secured to the block pairs 192, 194 as best illustrated in FIG. 7.

Prior to the installation of the improved heat dissipating connector assembly 150 in the existing light fixture 154, the base 162 of the lamp 156 is connected within a conventional ceramic electrical connector (not shown) disposed within the housing 152. A forward end flange 212 of the lamp 156 is engaged and supported by spring clip elements 214 (only one of which is illustrated in FIG. 6) that is carried by an annular insert 216 which is frictionally received within the forward end of the housing 152 and also supports the fixture lens 218. Disposed forwardly of the insert 216 is a representative louvered trim element 220 also frictionally received within the forward end of the housing 152.

To install the new connector assembly 150 in the existing fixture 154, the lamp 156, together with its supporting insert 216, the lens 218 and the trim element 220, are removed from the housing 152. The existing ceramic connector is then disconnected and also removed from the housing 152. The cooling body 168 is then secured to the rear wall 222 of the housing 152 by extending the connecting bolt 208 outwardly through an appropriate opening 224 formed in wall 222 and affixing a suitable nut 226 to the outer end of the bolt 208. To improve the heat transfer from the cooling body 168 to the rear wall 222 of the housing 152, a layer of a suitable thermal grease is placed between the rear surface 206 of the cooling body 168 and the interior surface of the rear housing wall 222. Alternatively, if desired, a sheet of graphite foil may be interposed between these two surfaces. Suitable power wiring connections are then made to the retrofitted connector assembly 150.

With the assembly 150 installed in this manner within the housing 152, the balance of the fixture 154 may be operatively reinstalled. During this re-installation process, the lamp base 162 is inserted into the socket opening $42_a$, and through a forward side opening 230 formed in the encapsulating insulation material 196, until the rear end of the lamp base 162 abuts the block pairs 192, 194 and the connector pins 166 enter their associated pin openings 202, 204. Insertion of the lamp base 162 into the socket opening $42_a$ bends the graphite foil portions 186 rearwardly within the socket opening, and compresses them between upper and lower side surfaces of the lamp base 162 and the interior surface of the socket opening. This compression of the foil element portions 186 compensates for planarity irregularities in such surfaces, and forms a very efficient and uniform thermal conductivity path therebetween.

According to an important feature of the improved connector assembly 150, the pin openings 202, 204 formed in the block pairs 192, 194 are provided with diameters just slightly smaller than those of the connector pins 166 which they receive. Accordingly, when the pins 166 are operatively inserted into the pin openings 192, 194 the metal blocks in each stacked pair thereof are caused to slightly separate against the resilient force of the encapsulating insulating material 196. This creates a frictional force between the block pairs and the lamp base pins inserted therebetween to thereby create a vey desirable "pin-wiping" action within the connector assembly 150. In conventional connector assemblies, this pin-wiping action is often provided by means of a rather complex system of internally spring-loaded contact members which are resiliently biased into engagement with the lamp base pins. In the present invention, however, this pin-wiping action is achieved in a significantly more reliable and less expensive manner.

During operation of the retrofitted light fixture 154, rearwardly directed radiant heat from the lamp reflector 158 is intercepted and absorbed by the integral heat shield means $117_a$ of the cooling body 168. The absorbed radiant heat is convectively dissipated to the interior of the fixture housing 152 by means of the external cooling fins 174 on the cooling body 168. Lamp base heat, from the lamp base itself and from heat radiated by the seal strips 164, is transferred to the graphite foil elements $100_a$ and conducted to the cooling body 168 for further dissipation into the interior of the housing 152.

Additional heat from the lamp base 162, and the connecting pins 166, is conducted to the metal block pairs 192, 194 and then transmitted through the thermally conductive insulating material 196 into the cooling body 168. This pin and lamp base heat initially conducted to the relatively massive internal heat sink defined by the metal block pairs is dissipated into the interior of the fixture housing 152 by the cooling fins 174, and is also conducted to the rear housing wall 222 through the thermal grease 228.

In these various manners, lamp base heat, seal element heat, and connecting pin heat is uniquely sinked away from the lamp by the improved heat dissipating connector assembly 150 to thereby significantly reduce the lamp operating temperature, and accordingly extend its operating life far beyond that normally occurring when the lamp is installed in conventional fixtures. The unique lamp heat dissipating abilities provided by the present invention may thus be easily and inexpensively incorporated in a variety of existing light fixtures.

Figure 8:
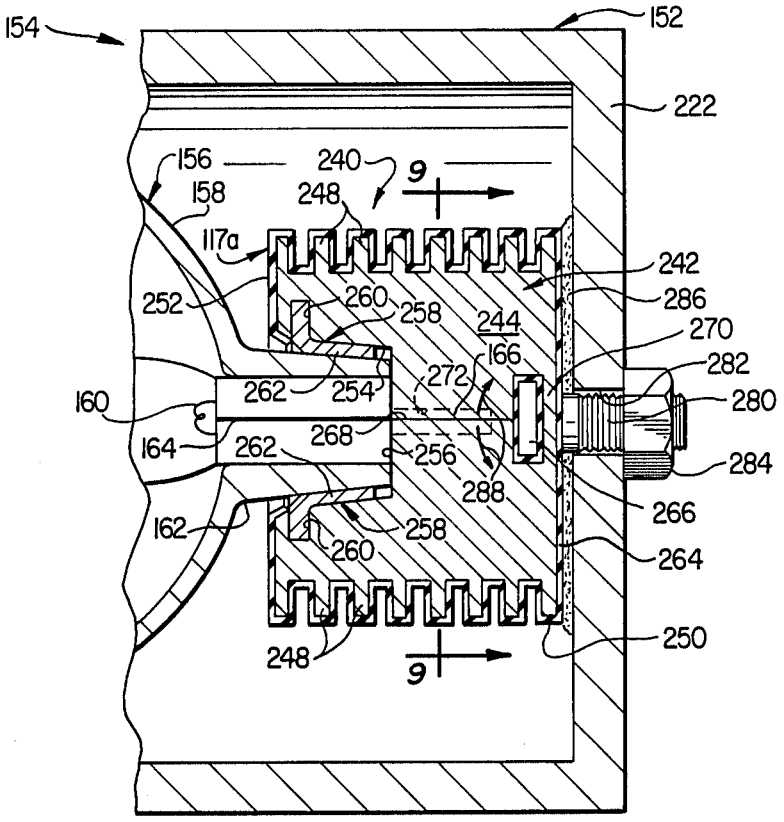
FIG. 8 is a fragmentary cross-sectional view, similar to that in FIG. 6, illustrating an alternate embodiment of the connector assembly installed in an existing light fixture housing.
Figure 9:
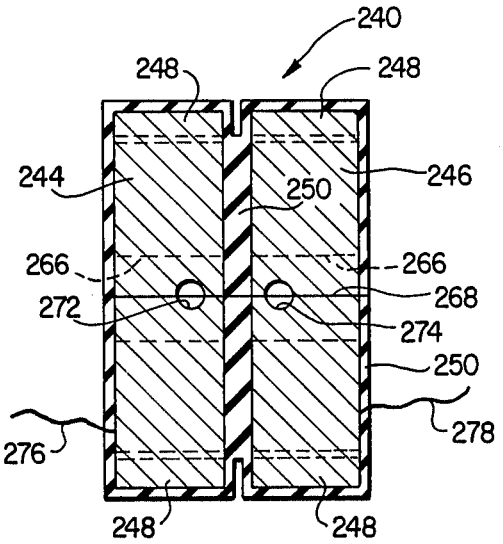
FIG. 9 is a cross-sectional view through the connector assembly of FIG. 8 taken along line 9—9 thereof.

Illustrated in FIGS. 8 and 9 is an alternate embodiment 240 of the heat dissipating connector assembly 150. Connector assembly 240 comprises a cooling body 242 defined by a pair of extruded aluminum sections 244, 246 having a series of external cooling fins 248 formed on their upper and lower side surfaces. The metal sections 244 and 246 are encapsulated within and laterally separated by a silicon insulating material 250 (similar to the previously described encapsulating insulating material 196) which is highly resistive to electrical current flow, but also has a fairly high degree of thermal conductivity.

A forward end portion 252 of the cooling body 242 defines the heat shield means $117_a$ and has formed therein a rectangularly cross-sectioned socket opening 254 having a rear end surface 256. Side edge portions of a pair of rectangularly shaped graphite foil elements 258 are captively retained within suitable slots 260 formed in the interior surface of the socket opening 254 so that the remainder 262 of each of the foil elements may be bent rearwardly into the socket opening 254 as best illustrated in FIG. 8. Positioned rearwardly of the socket end surface 256, and slightly forwardly of the rear end surfaces 264 of the metal sections 244, 246, are a pair of vertically centered rectangular openings 266 which are formed through the metal sections.

The cooling body 242 is vertically split along a cut line 268 which extends rearwardly from the forward end 252 of the cooling body to the openings 266 so that the vertically split portions of the cooling body 242 are joined only along relatively thin, insulation covered metal portions 270 positioned immediately behind the openings 266. A pair of pin openings 272, 274 are formed through the split metal sections 244, 246 along the cut line 268, and are of slightly smaller diameters than those of the lamp base connector pins 166. Suitable power lead wires 276, 278 are respectively connected to the split metal sections 244, 246.

To secure the connector assembly 240 within the existing fixture housing 152, a connecting bolt 280, formed from a suitable electrical insulating material, is secured to the rear end of the cooling body 242, is extended outwardly through a suitable opening 282 formed through the rear end wall 22 of the fixture housing, and is provided at its outer end with a retaining nut 284. A layer of thermal grease 286, or a suitable heat conductive foil element or the like, is positioned between the rear end of the cooling body 242 and the inner surface of the housing rear wall 222.

When the connector assembly 240 is secured in this manner within the fixture housing 152, the lamp 156 is secured to the connector 240 by inserting the lamp base 162 into the socket opening 254 until the rear end of the lamp base 162 abuts the rear surface 256 of the socket opening, and the connector pins 166 are received in their associated pin openings 272 and 274. Entry of the lamp base 162 into the socket opening 254 rearwardly bends and compresses the foil portions 262 within the socket opening as previously described. Entry of the pins 166 into the pin openings 272, 274 causes the vertically separated portions of the metal sections 244, 246 to slightly pivot (as indicated by the arrows 288) about and against the resilient restoration force of the thin rear metal portions 270 to maintain a desirable pin-wiping force on the connector pins 166.

During operation of the retrofitted light fixture 154 depicted in FIG. 8, rearwardly directed radiant heat from the lamp reflector 158 is intercepted by the heat shield means 177$_a$, which is interposed between the reflector and the portion of the cooling body 242 that receives the connector pins 166, is absorbed within the cooling body, and is then convectively dissipated via the cooling fins 248 to the interior of the fixture housing 152. Heat from the lamp base 162, the seal elements 164 and the connecting pins 166 is transferred (directly and through the foil elements 258) into the relatively massive internal heat sink defined by the split metal sections 244, 246. Heat transferred into such internal heat sink is convectively dissipated via the cooling fins 248 into the interior of the housing 152, and is further conductively transferred to the rear endwall 222 of the housing via the thermal grease 286. This transferred heat is then dissipated to ambient via the walls of the housing 152.

In a manner similar to that described in conjunction with the connector assembly 150, the assembly 240 uniquely functions to significantly lower the operating temperature of the lamp 156 to thereby greatly prolong its operating life.

The connector assemblies 150 and 240 described above are very easy and relatively inexpensive to manufacture and install in retrofit applications. They also advantageously provide, in somewhat different manners, internal heat sinks which, compared to the lamp bases and their connecting pins are relative massive to thereby quickly sink away larger portions of the lamp heat ordinarily retained within the reflector, the lamp base, its seal elements and the connecting pins. While the heat dissipating connector assemblies 150 and 240 just described are particularly well suited for retrofit installation applications, it will readily be appreciated that they could also be employed as original equipment in a variety of light fixtures designed for operation in conjunction with tungsten-halogen lamps or other similar lamp elements having high heat generation characteristics.

The foregoing detailed description is to be clearly understood as given by way of illustration and example only, the spirit and scope of the present invention being limited solely by the appended claims.

What is claimed is:

1. Lamp heat dissipating light fixture apparatus for use with a lamp having a hollow reflector, a base projecting outwardly from said reflector and having an outer end, and a bulb member extending through and supported by said base, said bulb member having a pair of electrical connector pins projecting outwardly beyond said outer end of said base, said light fixture apparatus comprising:

electrical connector means for removably receiving said base and said connector pins, for transmitting electrical power from an electrical power source to said bulb member through said connector pins, and for internally and simultaneously drawing heat from said base and said connector pins, essentially entirely by conduction, and then externally dissipating the base and connector pin heat internally conductd thereto to thereby substantially increase the operational life of said lamp, said electrical connector means including:

hollow, thermally conductive connector body means for internally receiving and externally dissipating heat, said connector body means having an internal cavity and an inwardly extending socket opening communicating with said internal cavity and adapted to removably receive said base, heat conducting means carried by said connector body means and positioned to be pressed into intimate contact between the interior surface of said socket opening and a peripheral exterior surface portion of said base, when said base is operatively inserted into said socket opening, to form a first highly conductive heat transfer path between said base and the interior surface of said socket opening, a spaced duality of thermally and electrically conductive pin receiving heat sink means positioned within said internal cavity for removably receiving said connector pins when said base is operatively inserted into said socket opening, and for conducting electrical energy from said source thereof to said connector pins while conductively receiving heat from said connector pins, and a thermally conductive, electrically resistive material disposed within said internal cavity, encapsulating and electrically isolating said duality of heat sink means from one another, and defining a second highly conductive heat transfer path from the exterior surface of said duality of heat sink means to the interior surface of said internal cavity, whereby, during operation of said lamp, heat generated by said base and said connector pins is simultaneously conducted to said connector body means through said first and second conductive heat paths, respectively, conducted outwardly through said connector body means, and then externally dissipated from said connector body means.

2. The light fixture apparatus of claim 1 wherein:

the portion of said connector body means in which said socket opening is formed is configured to define a heat shield generally interposed between said reflector and said duality of heat sink means and adapted to intercept and absorb radiation transmitted from said reflector toward said heat sink means.

3. The light fixture apparatus of claim 1 further comprising:

a hollow light fixture housing, and means for operatively supporting said electrical connector means within said light fixture housing.

4. The light fixture apparatus of claim 3 wherein:

said means for operatively supporting siad electrical connector means include means for forming a third conductive heat path between an exterior surface portion of said connector body means and an interior surface portion of said light fixture housing.

5. The light fixture apparatus of claim 4 wherein:

said means for forming a third conductive heat path include a layer of thermal grease interposed between said exterior surface portion of said connector body means and said interior surface portion of said light fixture housing.

6. The light fixture apparatus of claim 1 wherein:

said heat conducting means have a first portion secured to said connector body means, and a second portion bendable into said socket opening and adapted to be compressed between said lamp base and the interior surface of said socket opening to thereby permit repeated insertion and removal of lamp bases into and from said socket opening.

7. The light fixture apparatus of claim 6 wherein:

said heat conducting means include at least one graphite foil element.

8. The light fixture apparatus of claim 1 wherein:

said heat sink means comprise a duality of metal block structures, each being greatly larger in volume than the connector pin which its operatively receives.

9. The light fixture apparatus of claim 8 wherein:

said duality of metal block structures each comprises first and second separate portions resiliently held in engagement along facing surfaces thereof by said thermally conductive, electrically resistive material, said facing surfaces defining therebetween a pin opening for receiving one of said connector pins, and said pin openings are cross-sectionally smaller than said connector pins, whereby entry of said connector pins into said pin openings separates the engaged first and second portions against the resilient force of said thermally conductive, electrically resistive material to thereby create in said metal block structures an automatic pin-wiping action.

10. The light fixture apparatus of claim 9 wherein:

each of said duality of metal block structures is defined by a stacked pair of metal blocks.

11. The light fixture apparatus of claim 1 wherein:

said thermally conductive, electrically resistive material is a silicon insulating material.

12. The light fixture apparatus of claim 1 wherein:

said connector body means include two intersecured metal body sections.

13. The light fixture apparatus of claim 12 wherein:

said metal body sections are externally finned extrusions.

14. A method of operating a tungsten-halogen lamp including a base portion in a manner protecting said base portion against excessive heat build-up to thereby significantly prolong the operating life of said lamp, said base portion of said lamp having a pair of connector pins projecting outwardly therefrom, said method comprising the steps of:

providing an electrical connector having a highly thermally conductive outer body, an opening extending inwardly through said outer body and adapted to removably receive said lamp base portion, and a spaced duality of highly thermally conductive heat sink members disposed in said opening and adapted to receive said connector pins and transmit electrical energy thereto from an electrical source, said heat sink members being substantially more massive than said connector pins and being encapsulated in an electrical insulating material which has a high degree of thermal conductivity and is in intimate contact with outer surfaces of said heat sink members and an internal surface portion of said opening;

operatively inserting said base portion into said opening in said outer body;

transmitting electrical energy to said connector pins through said heat sink members;

externally cooling said base portion, essentially entirely by conduction, by transferring heat from the exterior surface thereof to the interior surface of said opening;

internally cooling said base portion, essentially entirely by conduction, by transferring heat from said connector pins to the interior surafce of said opening sequentially through said heat sink members and said electrical insulating material; and dissipating heat from the exterior surface of said outer body of said electrical connector.

15. The method of claim 14 further comprising the step of:

improving the heat conduction between said exterior surface of said base portion and said interior surface of said opening by interposing and compressing therebetween a heat conductive foil element.

* * * * *